US008342075B2

(12) United States Patent
Gomez

(10) Patent No.: US 8,342,075 B2
(45) Date of Patent: Jan. 1, 2013

(54) RECEIVER FOR AN AUTOLOADING FIREARM

(76) Inventor: Jesus S. Gomez, Cambridge, MD (US)

( * ) Notice: Subject to any disclaimer, the term of this patent is extended or adjusted under 35 U.S.C. 154(b) by 0 days.

(21) Appl. No.: 13/419,202

(22) Filed: Mar. 13, 2012

(65) Prior Publication Data

US 2012/0260793 A1 Oct. 18, 2012

Related U.S. Application Data

(63) Continuation of application No. 12/381,240, filed on Mar. 10, 2009, now abandoned.

(51) Int. Cl.
*F41A 5/18* (2006.01)

(52) U.S. Cl. ..... 89/191.01

(58) Field of Classification Search ..... 89/179, 89/191.01, 191.02, 192, 193; 42/6, 49.01, 42/49.02, 50, 10, 11, 14, 16, 17, 18
See application file for complete search history.

(56) References Cited

U.S. PATENT DOCUMENTS 3,636,647 A * 1/1972 Goldin ..... 42/50
3,771,415 A * 11/1973 Into et al. ..... 89/16
3,776,095 A * 12/1973 Atchisson ..... 89/128
4,433,610 A * 2/1984 Tatro ..... 89/148
4,563,937 A * 1/1986 White ..... 89/185
4,658,702 A * 4/1987 Tatro ..... 89/139
4,765,224 A * 8/1988 Morris ..... 89/191.01
5,183,959 A * 2/1993 McCoan et al. ..... 89/148
5,448,940 A * 9/1995 Schuetz et al. ..... 89/185
5,900,577 A * 5/1999 Robinson et al. ..... 89/191.01
6,019,024 A * 2/2000 Robinson et al. ..... 89/1.42
6,070,352 A * 6/2000 Daigle ..... 42/49.02
6,311,603 B1 * 11/2001 Dunlap ..... 89/1.4
6,536,153 B2 * 3/2003 Lindsey ..... 42/85
6,634,274 B1 * 10/2003 Herring ..... 89/33.14
6,651,371 B2 * 11/2003 Fitzpatrick et al. ..... 42/72
6,681,677 B2 * 1/2004 Herring ..... 89/33.14
6,718,680 B2 * 4/2004 Roca et al. ..... 42/70.08
6,722,255 B2 * 4/2004 Herring ..... 89/193
6,851,346 B1 * 2/2005 Herring ..... 89/1.4
6,901,691 B1 * 6/2005 Little ..... 42/118
6,971,202 B2 * 12/2005 Bender ..... 42/16
7,082,709 B2 * 8/2006 Lindsey ..... 42/85
7,131,228 B2 * 11/2006 Hochstrate et al. ..... 42/75.01
7,219,462 B2 * 5/2007 Finn ..... 42/49.01
7,231,861 B1 * 6/2007 Gauny et al. ..... 89/1.4
7,428,795 B2 * 9/2008 Herring ..... 42/75.01
7,444,775 B1 * 11/2008 Schuetz ..... 42/76.01
7,533,598 B1 * 5/2009 Murphy ..... 89/33.1
7,743,542 B1 * 6/2010 Novak ..... 42/7
7,762,018 B1 * 7/2010 Fitzpatrick et al. ..... 42/73
7,775,150 B2 * 8/2010 Hochstrate et al. ..... 89/193
7,886,470 B1 * 2/2011 Doiron ..... 42/69.02
7,966,760 B2 * 6/2011 Fitzpatrick et al. ..... 42/72
2003/0101631 A1 * 6/2003 Fitzpatrick et al. ..... 42/72
2003/0126781 A1 * 7/2003 Herring ..... 42/18
2003/0136041 A1 * 7/2003 Herring ..... 42/18
2004/0055200 A1 * 3/2004 Fitzpatrick et al. ..... 42/72

(Continued)

*Primary Examiner* — Jonathan C Weber
(74) *Attorney, Agent, or Firm* — Jacobson Holman PLLC

(57) ABSTRACT

Improved receiver set for an indirect or direct gas operated firearm wherein the charging handle has been moved to the side of the upper receiver, the magazine well has been flared open to better receive a magazine, and the lower receiver has a semi-circular shelf in the rear which supports the proximal end of the bolt carrier as it is longitudinally displaced due to firing of the weapon.

15 Claims, 8 Drawing Sheets

U.S. PATENT DOCUMENTS

2005/0011345 A1* 1/2005 Herring ..... 89/1.4
2005/0115140 A1* 6/2005 Little ..... 42/118
2005/0183310 A1* 8/2005 Finn ..... 42/49.01
2005/0183317 A1* 8/2005 Finn ..... 42/72
2005/0223613 A1* 10/2005 Bender ..... 42/16
2005/0262752 A1* 12/2005 Robinson et al. ..... 42/71.01
2006/0026883 A1* 2/2006 Hochstrate et al. ..... 42/75.01
2006/0283067 A1* 12/2006 Herring ..... 42/75.01
2007/0033851 A1* 2/2007 Hochstrate et al. ..... 42/75.01
2007/0199435 A1* 8/2007 Hochstrate et al. ..... 89/191.02
2009/0000173 A1* 1/2009 Robinson et al. ..... 42/75.02
2009/0007477 A1* 1/2009 Robinson et al. ..... 42/75.02
2009/0031606 A1* 2/2009 Robinson et al. ..... 42/16
2009/0031607 A1* 2/2009 Robinson et al. ..... 42/16
2009/0107023 A1* 4/2009 Murphy ..... 42/69.02
2009/0178325 A1* 7/2009 Veilleux ..... 42/117
2010/0154275 A1* 6/2010 Faifer ..... 42/90
2010/0162604 A1* 7/2010 Dubois ..... 42/18
2010/0205846 A1* 8/2010 Fitzpatrick et al. ..... 42/73
2010/0287808 A1* 11/2010 King ..... 42/85

* cited by examiner

RECEIVER FOR AN AUTOLOADING FIREARM

This is a continuation application of U.S. application Ser. No. 12/381,240, filed Mar. 10, 2009 now abandoned, the priority of which is hereby claimed.

BACKGROUND OF THE INVENTION

1. Field of the Invention

The disclosures herein relate generally to firearms. Specifically, the herein disclosure relates to the M16 series of firearms, and its derivatives. The improved receiver system described herein provides a side charging handle, a flared magazine well for more readily receiving a magazine, and a support feature in the lower receiver which prevents carrier tilt.

2. Description of the Prior Art

All U.S. patents and applications and all other published documents mentioned anywhere in this application are incorporated herein by reference in their entirety.

Without limiting the scope of the invention, a brief summary of some of the claimed embodiments of the invention is set forth below. Additional details of the summarized embodiments of the invention and/or additional embodiments of the invention may be found in the Detailed Description of the Invention below.

In the general area of auto-loading rifles, many systems exist which have had their success in military weapon procurements, some of which have migrated into the civilian sector.

The M16 family to include the AR15, AR10 and all of their derivates, has gained significant success with military, law enforcement and civilian shooters alike. Improvements to the M16 family of firearms are diverse in their purpose with new embodiments being developed regularly due to the inherent modularity of the base platform. This rifle design itself has undergone many refinements to improve its functional reliability, to expand its mission roles, and to reduce its manufacturing costs, yet the design's operable principles have not been significantly improved. Today, many manufacturers sell their own variations of this reputable rifle fitted to several calibers from .223 to .308.

The standard magazine well is straight walled and designed to receive any magazine which conforms to its basic shape and latch mechanism, well known in the prior art. The ability of the user to quickly insert a magazine is of paramount importance for military, law enforcement and civilian shooters. Military and law enforcement shooters need to quickly insert a magazine to provide ammunition to operate the firearm when they are engaged in a violent encounter. Civilian shooters, whose skills and ranking within their sport is based on time, need the ability to quickly insert a magazine into the magazine well of the host firearms receiver. The factory magazine well is narrow and easy to miss when the users are under pressure. Further, damage to the feed lips of the magazine can occur when the user drives the magazine into the side of the magazine well. Adding a flare to the magazine well to aid with the insertion of the magazine has been attempted by others. These solutions typically embody a secondary piece of material which incorporates the "flare" being bolted or otherwise secured to the factory magazine well. Unfortunately these designs are reliant on tension, bolts or other methods to remain affixed. Another solution is to machine the lower receiver with the larger magazine well opening, such as found with the JP Enterprises CTR-02 rifle.

Indirect gas operating systems for the M16 family of rifles and to a lesser extent direct gas operating systems, have a phenomenon called carrier tilt occur when the bolt carrier tilts back during normal operation. This tilting creates drag in the system which hinders the proper operation of the firearm and leads to premature wear of the lower, receiver and leads to numerous cycling related issues. The addition of an enlarged boss at the rear of the bolt carrier has been the method used to minimize carrier tilt. This solution does not entirely solve the problem in M16 type firearms, especially those which utilize higher pressure cartridges such as .308win.

With the use of silencers becoming main stream for military and civilian shooters a like gas blow back from the M16 family of firearms has become an issue of some concern. The addition of a silencer to a firearm generates an increased amount of gas blow back into the firearm's receiver with the majority of this gas blow back being vented through the ejection port and the charging handle void of the prior art rifles. Gas blow back consists of un-burnt powder particles, carbon and trace amounts of other gases. Having gas blow back from the firearm operating system being vented into the user's face is not only distracting but also presents a potential health problem for the shooter. Typically this situation has been addressed by impeding the exit of the gas blow back through the charging handle hole. Charging handles such as the one designed by PRJ (U.S. Pat. No. 6,311,603) reduce the gas blow back, but do not eliminate it.

Being able to force the bolt carrier assembly closed, under certain adverse conditions, became a significant design features of the M16A2 and later variants. A forward assist, well known in the prior art, was developed to provide the user a device which could be hit with the palm of the users hand to force the bolt carrier assembly, closed, or into battery. The M16 and the majority of its derivatives are designed, primarily, for a right handed shooter. The forward assist is on the right side of the weapon and requires the shooter to remove his hand from the pistol grip of the weapon to use it.

The present invention overcomes the undesirable features of the "factory" M16 type rifles. The lower receiver is machined with a magazine well flare, also known as a magazine funnel, to aid in the insertion of a magazine. Having the magazine well flare as an integral part of the receiver eliminates the inherent weakness of bolt on parts. The angle of the magazine well flare was selected for ease of use. This addition adds minimal cost to the production of the receiver with a noticeable gain in functionality.

A semi-circular shelf which is designed to guide the rear of the bolt carrier, into the buffer tube, is machined on the inner surface of the lower receiver near the receiver extension. This shelf guides the bolt carrier into the buffer tube and prevents it from tilting down to strike the lower portion of the receiver extension. The void for the charging handle in the upper receiver has been removed to prevent gas blow back from exiting at this point into the shooter's face. Removal of the charging handle void is made possible by the inclusion of a side charging handle which facilitates the manual operation of the host firearm action.

A charging handle has been added to the left side of the rifle. Further, the charging handle location allows the shooter to keep the primary firing hand on the firearm and maintain a sight picture while loading and unloading the rifle. By depressing the knob located on the side of the charging handle a tab is placed in operational contact with the bolt carrier and allows the user to force the bolt carrier assembly forward should the situation warrant it. This is a replacement for the prior art forward assist and is advantageous over the previous design because the shooter does not have to remove his hand from the firing grip of the weapon to use it. Similar side charging handles are used on the FN F AL type rifle, and its variation, but the prior art does not teach how to make an operable combination of components.

A brief abstract of the technical disclosure in the specification is provided as well only for the purposes of complying with 37 C.F.R. 1.72. The abstract is not intended to be used for interpreting the scope of the claims.

OBJECTS AND ADVANTAGES

Accordingly several objects and advantages of the present invention are (a) To provide a flare to the magazine well that aids in the insertion of a magazine.

(b) To provide a support shelf located at the rear of the lower receiver which guides the bolt carrier through the receiver extension into the buffer tube thereby preventing the bolt carrier from contacting the receiver extension.

(c) To provide an upper receiver that lacks the gap normally present at the rear of the receiver, thus preventing the exit of gases from the operating system from venting into the shooter's face.

(d) To provide an alternate way of charging the firearm.

(e) To provide a forward assist option which does not require the user to remove his hand from the firing grip of the firearm.

Still further objects and advantages will become apparent from a consideration of the ensuing description and drawings.

SUMMARY

The present firearm design is an improvement of the prior art receiver system typified by the "M-16" design concept and is suitable, for both direct and indirect gas operating systems. An angled flare is added to the bottom of the magazine well as a means to assist the users of the host firearm in the rapid insertion of a magazine. This magazine flare will provide a larger opening at the base of the magazine well, thus allowing an increased margin of error for the user when attempting to quickly, often under stress, insert the loaded magazine. With the addition of a raised shelf in the lower receiver of the host firearm, the rear or "boss" of the bolt carrier is prevented from tilting down, from the upper receiver, into the lower receiver. This tilt creates drag on the operating system and can damage the receiver extension. The charging handle being moved to the side of the receiver offers several marked improvements over the prior art. Positioning the charging handle on the left side allows the shooter's primary firing hand to stay on the pistol grip while the weapon is being loaded or unloaded. Further, it is possible for the shooter to maintain the sight alignment and sight picture of his firearm because the head no longer needs to be removed as is the case when the prior art charging handle is retracted to the rear of the receiver. By eliminating the void for the charging handle, hot gas and carbon are no longer able to exit from the rear of the upper receiver into the shooter's face. Succinctly stated, the improved receiver design for an M-16 type rifle presented by the herein described invention can be distinguished from the prior art by a charging handle protruding from the left side of the receiver, a semi-circular shelf being located in the lower receiver in front of the receiver extension, and a magazine well flare which is integrally machined into the lower receiver.

BRIEF DESCRIPTION OF THE DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENTS

Figure 1:
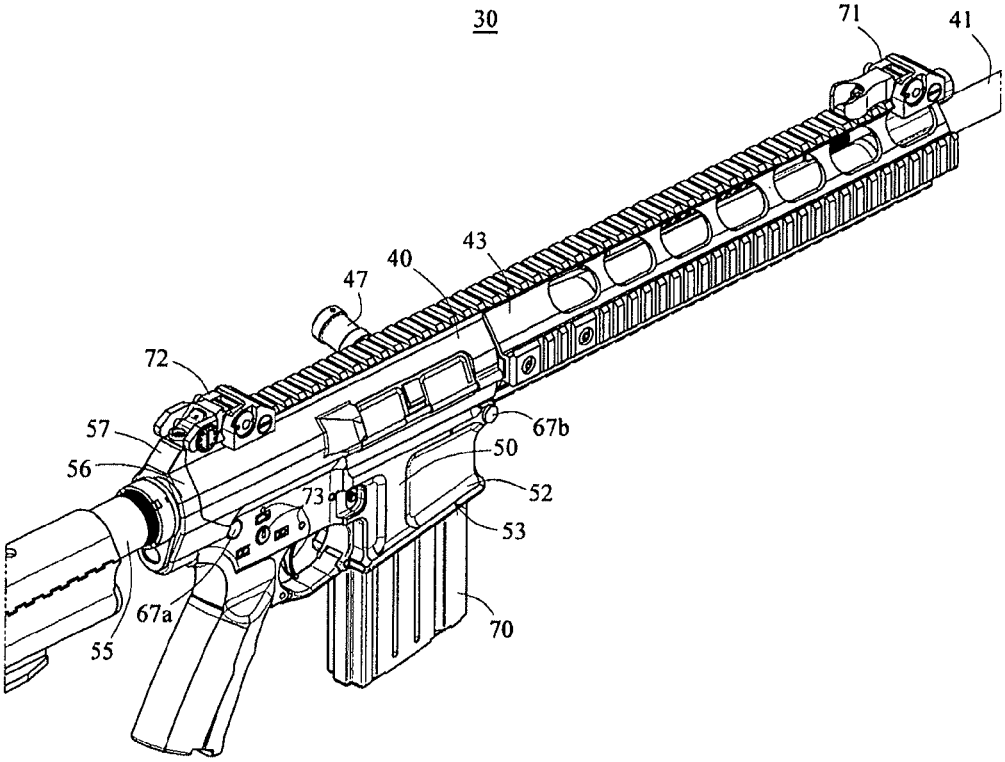
FIG. 1 is a side perspective view of my improved receiver for an autoloading firearm incorporated for use with an M16 type firearm.

Turning now to the drawings in which like reference characters indicate corresponding elements throughout the several views, as used herein, the word "front", or "distal" corresponds to the firing direction the assembled firearm 30 is facing in FIG. 1 (i.e., to the right as shown in FIG. 1); "rear" or "proximal" or "back" corresponds to the direction opposite the firing direction of the assembled firearm 30 (i.e., to the left as shown in FIG. 1).

Unless otherwise specified, the various components which make up the trigger mechanism, buttstock assembly, bolt carrier assembly, barrel assembly are as those found on the prior art M16/M4 rifles and their various embodiments.

Figure 2:
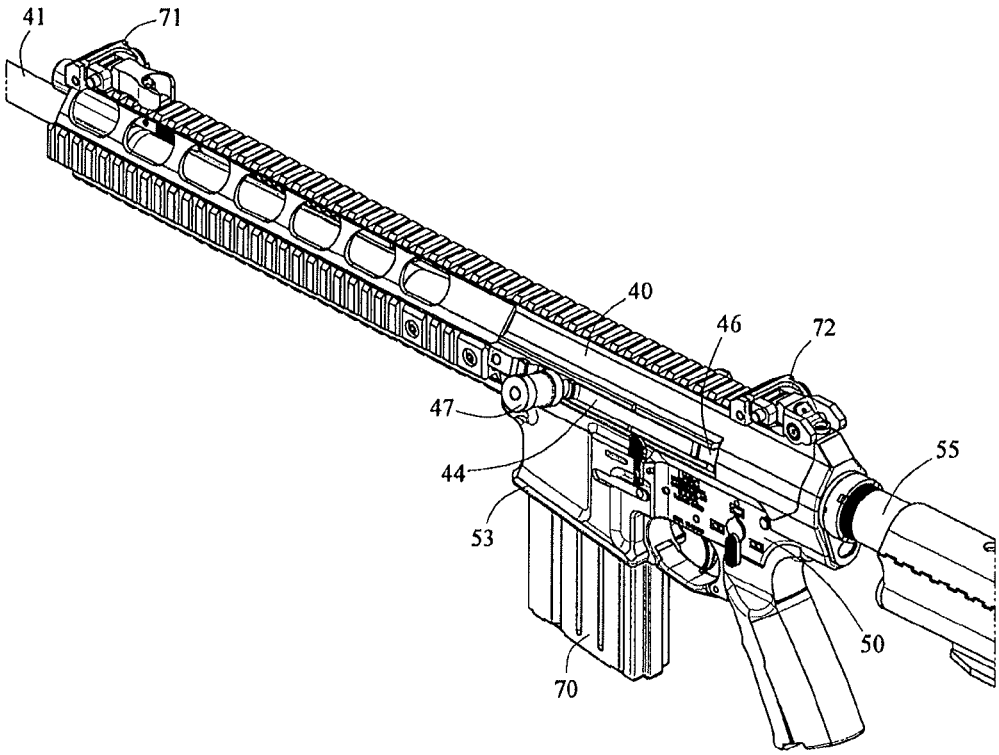
FIG. 2 is a side perspective view rotated 120 degrees thereof.

Referring to FIGS. 1 & 2, there is shown a side elevation view of an autoloading firearm 30 capable of full automatic or semiautomatic fire and incorporating features in accordance with the preferred embodiment of the present invention. Although the present invention will be described with reference to the embodiments shown in the drawings, it should be understood that the present invention can be embodied in many alternate forms of embodiments. In addition, other elements or materials of suitable size, shape or type could be used.

Firearm 30 may be direct gas operated, such as the M4 or M16 type. Firearm 30 may have operational features such as the indirect gas, operating system, disclosed in U.S. Pat. No. 7,461,581, which is hereby incorporated by reference herein in its entirety. In general, indirect gas operated rifles are referred to as "piston operated". The firearm 30 and its components described in greater detail below are merely exemplary, and in alternate embodiments the firearm 30 may have other components or systems. Firearm 30 may incorporate an upper receiver section 40 incorporating a barrel 41, piston sub-assembly 42, handguard 43, bolt carrier assembly 45, and a side charging handle 44. An alternate embodiment of the firearm 30 may have a direct gas system where a gas tube replaces the piston sub-assembly 42. Typically, the firearm 30 incorporates a stock 51, lower receiver 50, magazine well 52, magazine 70, and front and rear sights 71, 72. As will be described below, the upper receiver 40, having a barrel 41, incorporates a side charging handle 44 not found on prior art rifle designs in of the M16 or M4 type rifles. Additionally, a flare 53 or chamfer about the exterior opening of the magazine well 52 is provided for. Still further, a semi-circular shelf 54 located at the proximal end of the lower receiver 50. The semi-circular shelf 54 supports the rear or proximal end of the bolt carrier assembly 45, thereby preventing the proximal end of the bolt carrier assembly 45 from striking the lower receiver 50, during the normal reciprocation of the bolt carrier assembly 45 within the upper receiver 40. The upper receiver 40 and the lower receiver 50 are secured together by two take down pins 67*a*, 67*b* (used in the prior art). These features combine to make a firearm 30 which offers both increased reliability and improved ergonomics.

The handguard 43, illustrated in FIGS. 1 & 2, has vent holes, integral external rails, and a means to remove the upper rail to allow for easy maintenance of the piston sub-assembly 42. In this preferred embodiment, the proximal end of the rail is supported on a barrel nut which is threadedly secured to the distal end of the upper receiver 40. Rails conforming to the 1913 mil. std., are integral to the handguard 43. In an alternate embodiment the rails may number more or less and be provided in multiple mounting locations or mounting angles on the handguard 43. The handguard 43 and upper receiver 40 are assembled such that collimating between the rails of each device and the barrel's 41 centerline are maintained. Handguard 43 allows for the attachment of a removable upper portion with integral 12 o'clock rail 49. The removable upper portion 49 has a keyed/key way system or modified tongue and groove system such as is disclosed in U.S. patent application Ser. No. 12/217,874. In alternate embodiments, other mating and locking features could be provided to secure the upper portion 49 with the handguard 43 assembly. This disclosure regarding the handguard 43 is in no way the sole embodiment of the herein disclosed device and should not be interpreted as a limit to the scope of the design presented herein.

The trigger mechanism 73 depicted includes a trigger, hammer (shown in FIG. 6), trigger and hammer pins, and a safety selector; additionally there are several springs which interact with the aforementioned components. This trigger mechanism 73 is the type commonly found in the prior art and therefore is not discussed in any greater detail.

Figure 3:
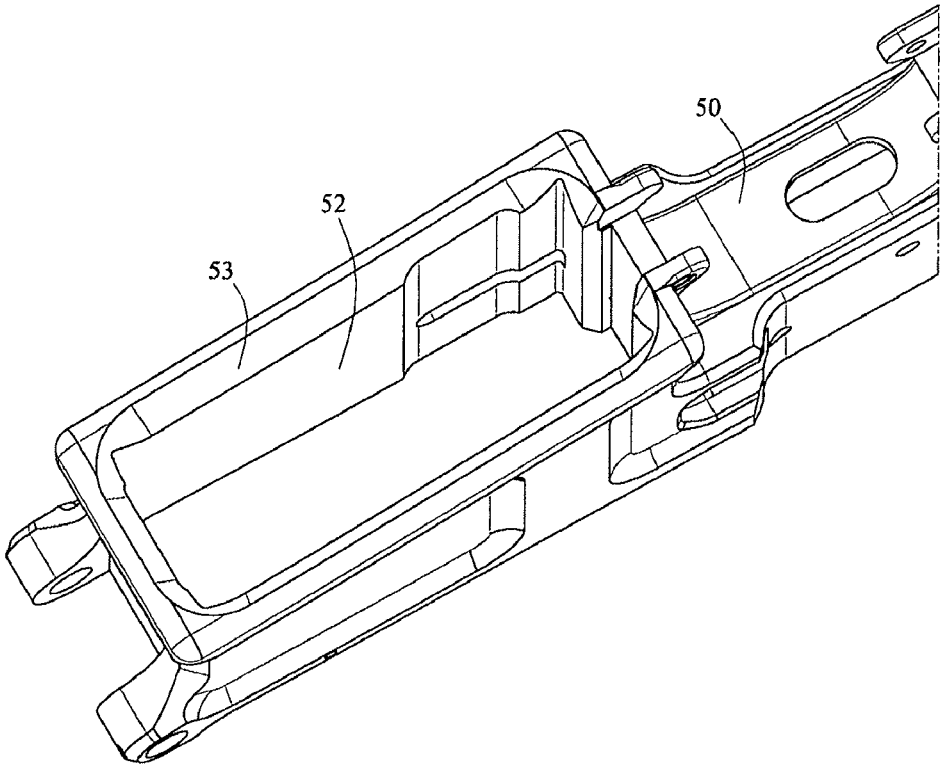
FIG. 3 is perspective view of the preferred embodiments magazine well.
Figure 4:
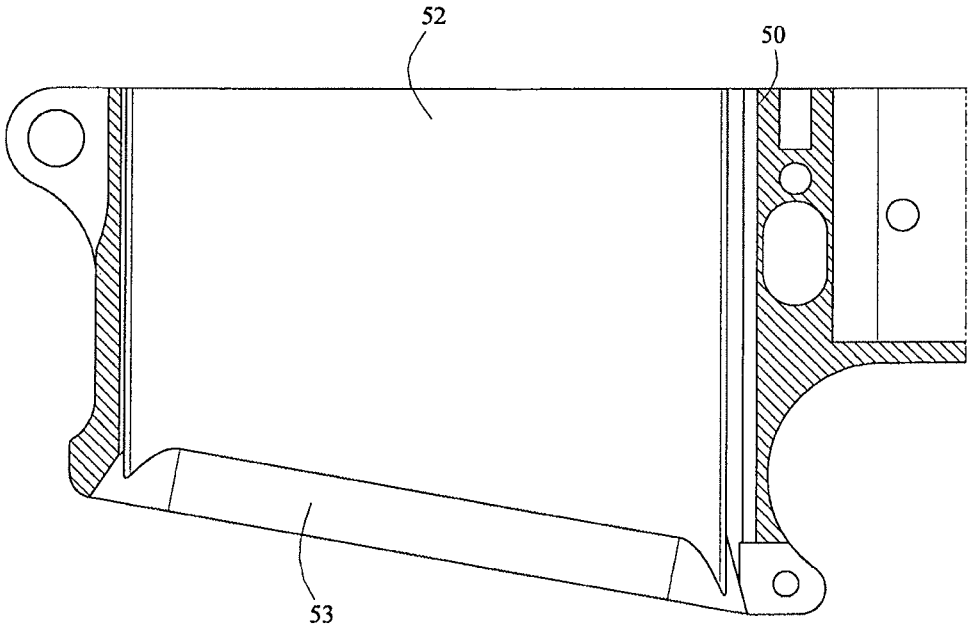
FIG. 4 is a side cutaway view thereof.

In FIGS. 3 & 4, there are illustrated views of the lower receiver 50 (stripped of all operational components) and, in particular, the magazine well 52. The magazine well 52 has a top, bottom, and side surface where the bottom surface is defined as the area where the bevel or flare 53 is located. The top surface is the other exit which opens into the upper receiver 40, and the inside surface is the area between the two openings. The magazine well 52 is flared out on all four sides to aid in the insertion of a magazine 70 (see FIGS. 1 & 2). Prior art magazine wells are straight walled and are cut to a dimension just large enough to receive a magazine 70. If the user, due to stress such as is experienced in combat and criminal encounters, attempts to insert the magazine 70, it is possible that the feed lips, located at the top of the magazine, will snag on the magazine well. The addition of a magazine well flare 53 aids the user during the insertion of a loaded magazine 70 into the magazine well 52 by providing an opening of increased size which incorporates walls outwardly slanted to direct the magazine 70 into the magazine well 52. In the preferred embodiment, the magazine well 52 has a 15 degree outward sloped angle on the rear surface. The front surface has a 35 degree angle, and the sides of the magazine well have a 25 degree angle flare 53, or bevel, as measured from the inside vertical wall. Others have attempted to add these features through various clamp-on devices, but these devices offer their own disadvantages. Clamp-on devices designed to add a surface which is outwardly sloped to aid in the insertion of the magazine well include various screws and washers which have a tendency to become unthreaded, allowing the device to fall off of the firearm. For these reasons there exists a need to improve upon these prior solutions.

Figure 5:
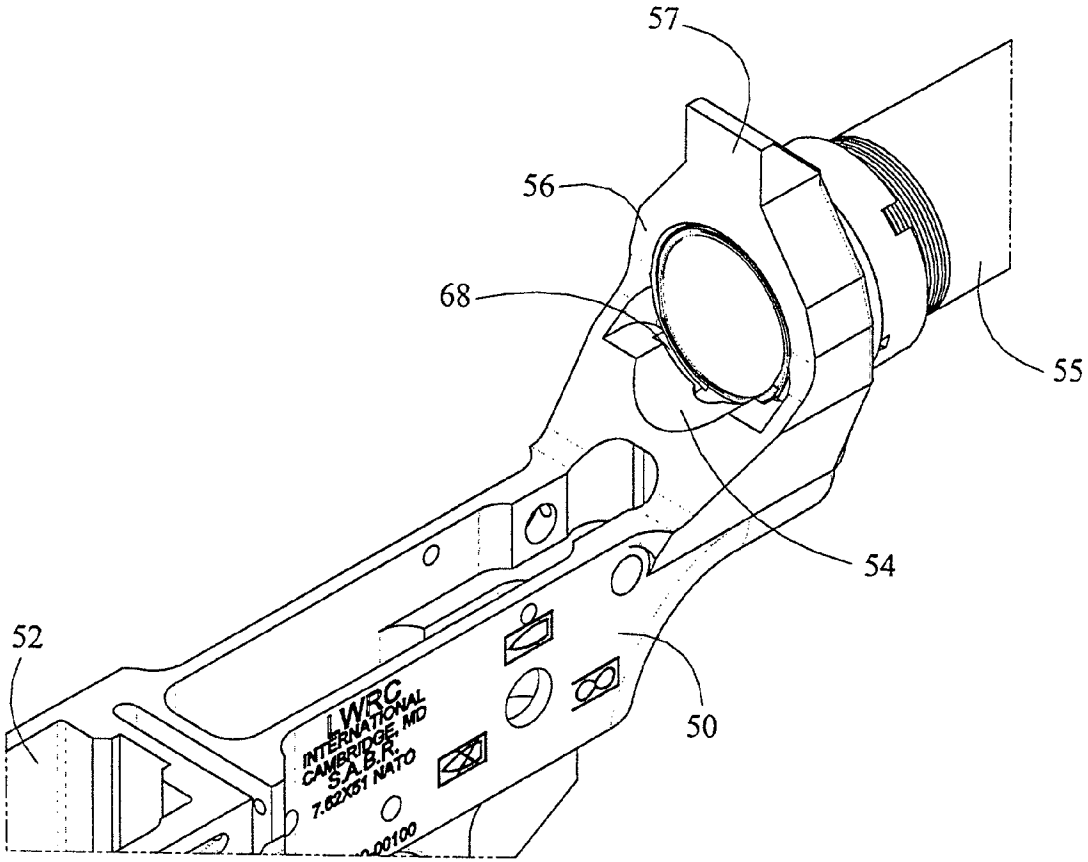
FIG. 5 is an angled side view showing the interior of the lower receiver found on the preferred embodiment of the herein disclosed invention.
Figure 8:
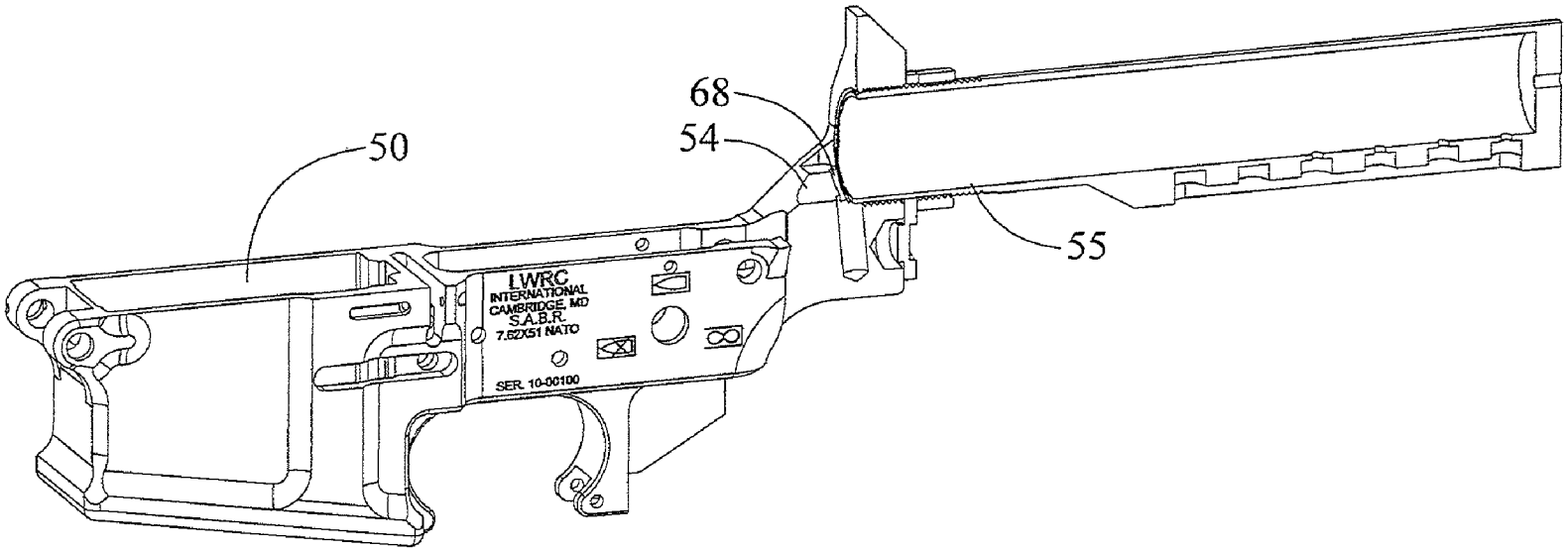
FIG. 8 is a partial cutaway view of the lower receiver.

FIG. 5 shows a side perspective view of the lower receiver 50 with the buffer tube 55 threaded and retained in place. FIG. 8 shows the lower receiver 50 shown in FIG. 5, in a partial cutaway view making the gap 68 between the interior of the buffer tube 55 and the external surface of the shelf 54 more visible. The shelf 54, semicircular in shape, is located at the proximal end of the lower receiver 50 adjacent to the receiver extension 56. In general, the shelf 54 is constructed so that it provides a guidance and support surface for the rear of the bolt carrier assembly 45. As can be seen in FIG. 5, the semi-circular surface which defines the shelf 54 is elevated above the area where the buffer tube 55 and receiver extension 56 are threaded together. This prevents the rear of the bolt carrier assembly 45 from striking the lip of the buffer tube 55 which is exposed when the buffer tube 55 is fully seated in the receiver extension 56. The exterior of the semi-circular surface defined as the shelf 54 occupies the same plane as the lower interior portion of the buffer tube 55, as shown in FIGS. 5 and 8, and is constructed such that the bottom of the buffer tube's interior is in line with the semi-circular shelf. The bottom of the rear end of the bolt carrier assembly 45 is therefore supported, while it is reciprocating, by the shelf 54. The shelf also reinforces the receiver extension 56 and prevents the proximal end of the bolt carrier assembly 45 from striking the area where the shelf 54 is presently located. Prior art designs do not have a shelf 54, as seen in this preferred embodiment, and rely solely on the bolt carrier assembly 45 being guided into the buffer tube 55 by the upper receiver 40. Piston operated firearms 30 often exhibit a trait called carrier tilt, where the rear or proximal end of the bolt carrier assembly 45 tilts down into the lower receiver 50, as a result of the force imparted by the firearm's piston sub-assembly 42 to the bolt carrier 45. By adding support to the lower receiver in the form of a semi-circular shelf 54, the rear of the bolt carrier assembly 45 is supported during its entire length of travel thus preventing carrier tilt. Carrier tilt can lead to various feeding and extraction malfunction for the firearm 30 and even result in the receiver extension 56 breaking off of the lower receiver 50 rendering the firearm 30 inoperable.

A block 57 is machined into the top of the receiver extension which, when mated to the upper receiver 40 (shown in FIG. 1), prevents the expanding gases, resulting from the discharge of the host firearm, from blowing into the user's face. Prior art M4 and M16 type rifles have a device called a charging handle which is used to manually operate the action of the firearm. There are gaps between the upper receiver and the charging handle which allow for hot gases to escape and hit the user in the face. This is of particular concern when a silencer (well known in the art) is used in conjunction with a direct or indirect gas operating firearm. The lack of a charging handle opening in the upper receiver 40 and the presence of the block 57 above the receiver extension 56 of the lower receiver 50 prevent hot, expanding gases from exiting the firearm's 30 upper and lower receivers 40, 50. Due to the above reasons, the changes made to this receiver system offer an advantage over the prior art upper and lower receiver configuration.

Figure 6:
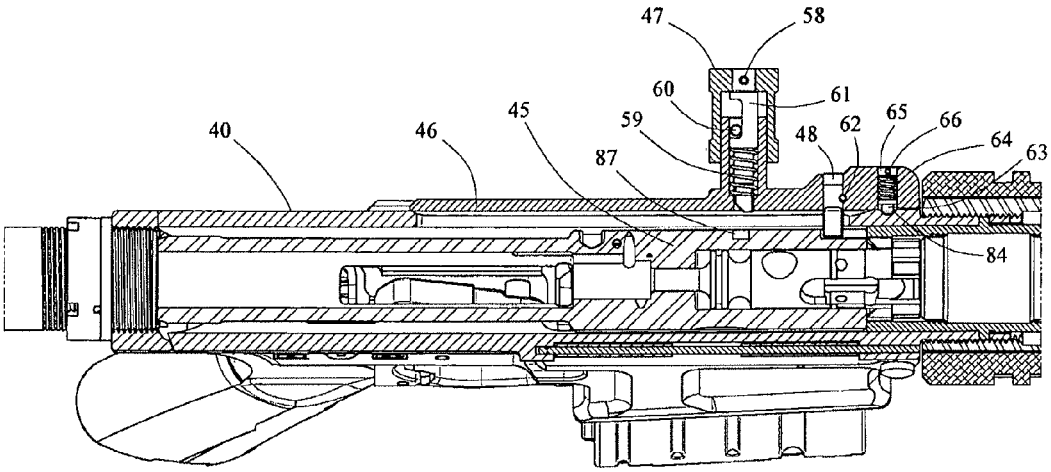
FIG. 6 is a cutaway view of the upper receiver associated with the herein disclosed device.

Illustrated in FIG. 6 there is shown a cut away view of the upper receiver 40. The side charging handle 44 assembly is present on the left side of the upper receiver 40 (see FIG. 7 for a detailed description of the subassembly). There is a guide groove 46 for the charging handle 44. The charging handle 44, itself, has a protruding knob 47 which is ergonomic, and easily grasped by the user of the firearm 30. The side charging handle 44 has a tab 48 which protrudes through the guide groove 46 into the upper receiver 40 and interacts with the distal end of the bolt carrier assembly 45, thereby allowing for the manual cycling of the firearm's action during loading, unloading, and malfunction clearance operations. The placement of the charging handle 44 and its knob 47 allow the user to maintain a sight picture and keep a firing grip on the weapon while operating the action. This is a significant departure from prior art designs which use a charging handle that has a travel path across the cheek rest area used by the shooter when aiming the firearm. To load, unload, and perform malfunction clearance operations, the user must remove his face from the cheek rest area, thereby losing his sight picture and sight alignment, resulting is an undesirable situation for the operator of a firearm equipped as such.

Figure 7:
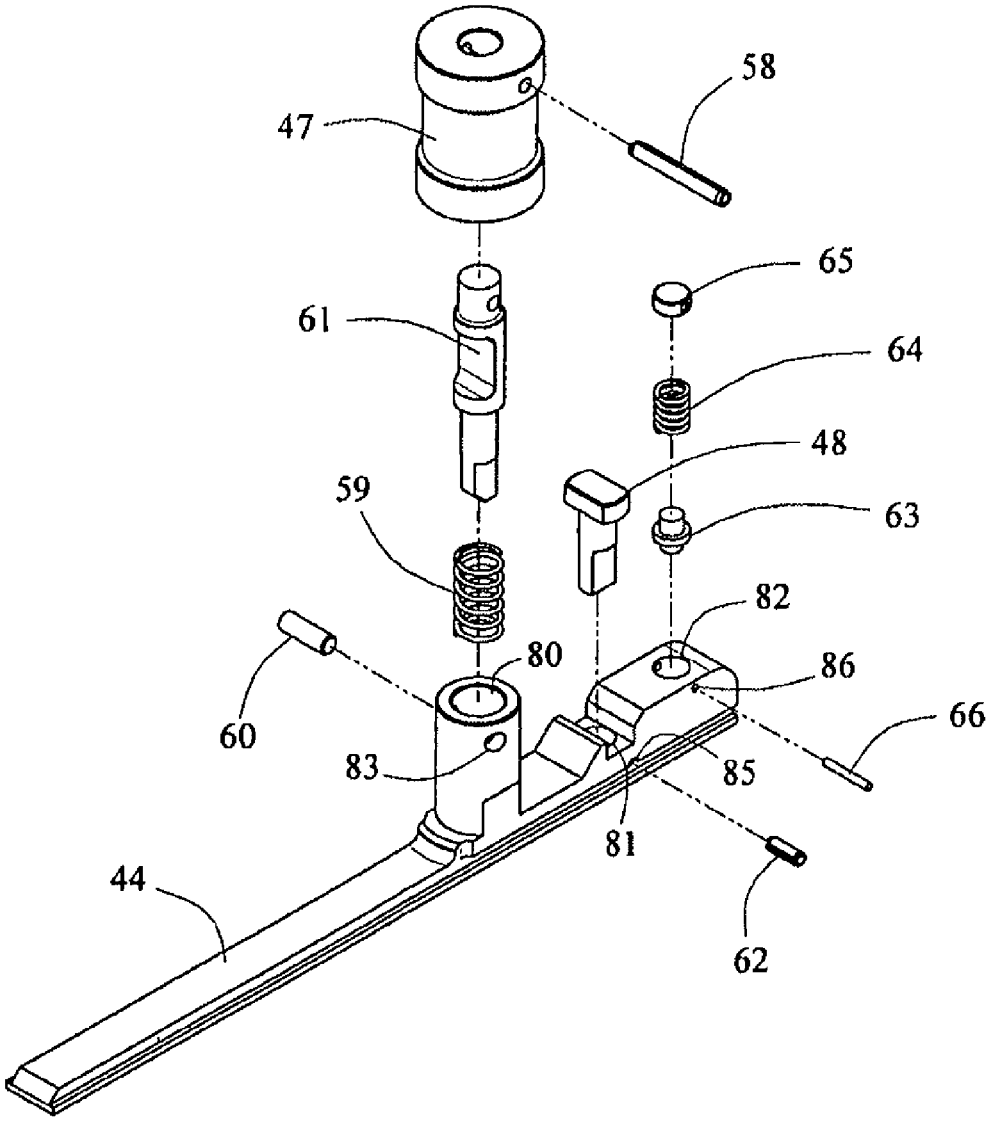
FIG. 7 is an exploded view of the side charging handle assembly.

Shown in FIG. 7 is an exploded view of the side charging handle 44 and its subcomponents. Three openings 80, 81, 82 are present near the distal end of the side charging handle 44. The opening 80 closest to the mid-section houses the forward assist tab 61, a spring 59 which biases the forward assist tab 61 away from the upper receiver 40, and a retaining pin 60. The knob 47 of the side charging handle 44 attaches to the external end of the bolt hold open tab 48 and is retained in place by a roll pin 58. The charging tab 48 is housed within an opening 81 in the charging handle assembly 44 with a roll pin 62 restraining it in place. Near the distal end is an opening 82 which houses the restraining tab 63, a spring 64 which biases against the tab 63, a retaining cap 65 and a roll pin 66 which secures the assembly in place.

Reassembly of the herein disclosed receiver system is nearly identical to the method of assembly used in prior art M16 type rifles. The piston-subassembly is outside the scope of this disclosure and neither this assembly nor the handguard is covered in detail. The side charging handle 44 is assembled by being slid into the guide groove 46; the spring 59, and forward assist tab 61 are inserted into the appropriate opening 80 and retained in place by the roll pin 60 58 which is inserted into a void 83, then the knob 47 is placed over the forward assist tab 61 and retained in place by the roll pin 58; the tab 48, which is in operational contact with the charging handle 44 of the bolt carrier assembly 45, is then inserted into the opening 81 and secured in place with the roll pin 62 that is inserted into the provided opening 85; a restraining tab 63, spring 64 and retaining cap 65 are placed within an opening 82 and retained by the roll pin 66 in the provided opening 86. The restraining tab 63 interacts with a dimple 84 located at the distal end of the guide groove 46 to prevent the unintentional movement of the side charging handle 44.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the amended claims.

CONCLUSION, RAMIFICATIONS AND SCOPE

Accordingly the reader will see that the present invention provides an improved receiver system for an autoloading firearm which is comprised of an upper and lower half. Significant changes have been made to the lower and upper receivers 40, 50 to improve the function of the herein described firearm 30. A side charging handle 44 has been provided, which allows the user to maintain sight picture and sight alignment while loading and unloading the firearm 30, eliminating the need for an opening in the back of the upper receiver 40. Further, a shelf 54 has been provided which supports the proximal end of the bolt carrier assembly 45, thus preventing carrier tilt and the malfunctions and wear associated therewith. In addition, the opening in the magazine well 52 is larger in diameter than found in the prior art and has an angled flare about the opening in the magazine well 52 to assist the user with the insertion of a loaded magazine 70 under stress.

Another embodiment of the improved receiver for an autoloading firearm 10 could omit the side charging handle 44. Instead the shelf 54, located at the proximal end of the lower receiver 50, and the magazine well flare 53 may be incorporated into the firearm 30 lower receiver 50 with the prior art charging handle mechanism used to manually cycle the action or bolt carrier assembly 45.

While my above drawings and description contain much specificity, these should not be construed as limitations on the scope of the invention, but rather as an exemplification of one preferred embodiment thereof.

Accordingly, the scope of the invention should be determined not by the embodiments illustrated, but by the appended claims and their legal equivalents.

What is claimed is:

1. A firearm with a gas operating system and a dual receiver assembly, comprising: an upper receiver assembly configured for receiving magazine-fed ammunition, and having a mechanism for manually reciprocating the action of the firearm; a lower receiver assembly attached to the upper receiver assembly, said lower receiver assembly being configured to have an ammunition magazine attached thereto for supplying ammunition from the ammunition magazine to the upper receiver assembly; said upper receiver assembly being detachable from the lower receiver assembly; a buffer tube having a bore with a forwardly facing opening; a bolt carrier assembly operative with said buffer tube during firearm operation; said lower receiver having a support element located in front of the buffer tube opening to support and guide the rear of the bolt carrier assembly during the normal operation of the firearm, said support element having an external surface which substantially occupies a same plane as the bore of the buffer tube, said plane being defined by a lower side of the buffer tube opening.

2. The firearm with a gas operating system and a dual receiver assembly of claim 1 wherein the lower receiver assembly houses a trigger group mechanism, and the support element that guides the rear of the bolt carrier includes a semi-circular shelf located on an upper surface of said support element.

3. The firearm with a gas operating system and a dual receiver assembly of claim 2, wherein said bolt carrier is in operational contact with the shelf provided on said lower receiver.

4. The firearm with a gas operating system and a dual receiver assembly of claim 1, wherein the support element that guides the rear of the bolt carrier assembly during its normal cycle of operation includes a semi-circular shelf which is located in front of the buffer tube opening, said shelf supporting a rear of the bolt carrier assembly during its entire length of travel to prevent carrier tilt.

5. The firearm with a gas operating system and a dual receiver assembly of claim 4, further comprising an upwardly directed receiver extension on said lower receiver, the semi-circular shelf being located at a rear end of the lower receiver adjacent the receiver extension.

6. The firearm with a gas operating system and a dual receiver assembly of claim 5, wherein said shelf reinforces said receiver extension against force imparted on said bolt carrier assembly by a piston assembly of said firearm upon discharge.

7. The firearm with a gas operating system and a dual receiver assembly of claim 5, wherein a top of said receiver extension has an upward projection that, when the lower receiver assembly is mated with the upper receiver assembly, prevents expanding gases that result from firearm discharge from blowing into a gun operator's face.

8. A firearm with a gas operating system and a dual receiver assembly, comprising:

an upper receiver assembly having a bolt carrier assembly that reciprocates rearwardly and forwardly therein during normal operation of the firearm;

a lower receiver assembly removably attached to the upper receiver assembly, a rear end of said lower receiver assembly being configured to have a buffer tube engaged therewith; and a shelf formed in said rear end of said lower receiver assembly, said shelf supporting a rear end of the bolt carrier assembly during firearm operation and preventing said rear end from striking the lower receiver assembly during reciprocation of said bolt carrier assembly.

9. The firearm with a gas operating system and a dual receiver assembly of claim 8, further comprising a receiver extension coupled to said rear end of said lower receiver assembly, and a buffer tube threadedly engaged within said receiver extension and having a forwardly facing buffer tube opening, said shelf being positioned adjacent to and reinforcing said receiver extension.

10. The firearm with a gas operating system and a dual receiver assembly of claim 9, wherein said receiver extension and said buffer tube are located behind said shelf.

11. The firearm with a gas operating system and a dual receiver assembly of claim 10, wherein an external surface of said shelf is on substantially a same plane as a lower interior surface of the buffer tube.

12. The firearm with a gas operating system and a dual receiver assembly of claim 11, wherein the shelf that supports the rear of the bolt carrier assembly during its normal cycle of operation is located in front of the buffer tube opening, said shelf supporting a rear of the bolt carrier assembly during its entire length of travel to prevent carrier tilt.

13. The firearm with a gas operating system and a dual receiver assembly of claim 11, said bolt carrier being in operational contact with the shelf provided on said lower receiver assembly.

14. The firearm with a gas operating system and a dual receiver assembly of claim 10, wherein said shelf is semicircular.

15. The firearm with a gas operating system and a dual receiver assembly of claim 9, wherein a top of said receiver extension has an upward projection that, when the lower receiver assembly is mated with the upper receiver assembly, prevents expanding gases that result from firearm discharge from blowing into a gun operator's face.

* * * * *